US005879215A

United States Patent [19]

Duffy et al.

[11] Patent Number: 5,879,215

[45] Date of Patent: Mar. 9, 1999

[54] CRIMP LENGTH GAUGE FOR CERAMIC METAL HALIDE ELECTRODES

[75] Inventors: Mark E. Duffy, Shaker Heights; Raymond A. Heindl, Euclid, both of Ohio

[73] Assignee: General Electric Company, Schenectady, N.Y.

[21] Appl. No.: 797,704

[22] Filed: Feb. 11, 1997

[51] Int. Cl.[6] ..... H01J 9/42

[52] U.S. Cl. ..... 445/3; 445/63

[58] Field of Search ..... 445/3, 26, 63

[56] References Cited

U.S. PATENT DOCUMENTS 5,209,689 5/1993 Griffin et al. ..... 445/3

*Primary Examiner*—Kenneth J. Ramsey

*Attorney, Agent, or Firm*—Fay, Sharpe, Beall, Fagan, Minnich & McKee

[57] ABSTRACT

A method and apparatus for assembling a ceramic metal halide high intensity discharge (HID) lamp is disclosed. The apparatus includes a base adapted to receive a ceramic arc tube body, a movable gauge arm having a first portion contacting an end surface of the arc tube body, an electrode holder for supporting an electrode in contact with a second portion of the gauge arm, and a crimper for securing a stop to the electrode at a position determined by the extent of movement of the gauge arm. The apparatus permits stops to be secured to electrodes, either simultaneously or sequentially, thereby correcting for a length deviation of the arc tube body. As a result, half of the required correction is made on each electrode. Since both electrodes are set to the same insertion length, an arc gap is inherently centered in the arc tube body during assembly.

16 Claims, 4 Drawing Sheets

Fig.1
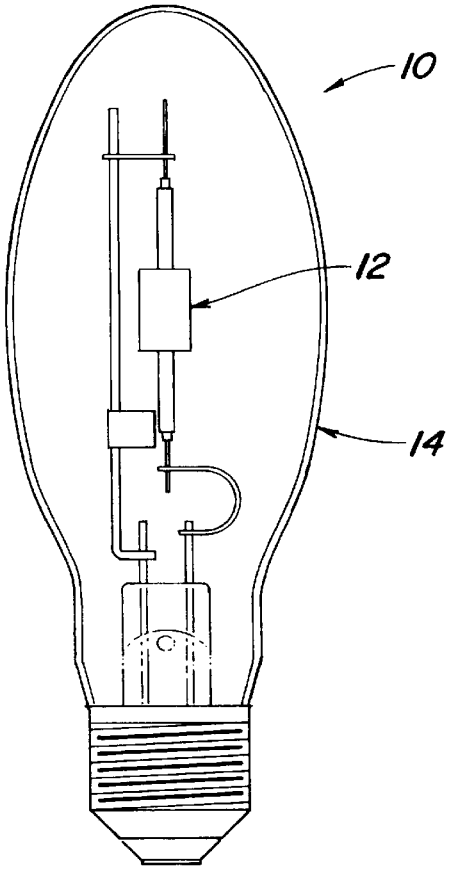
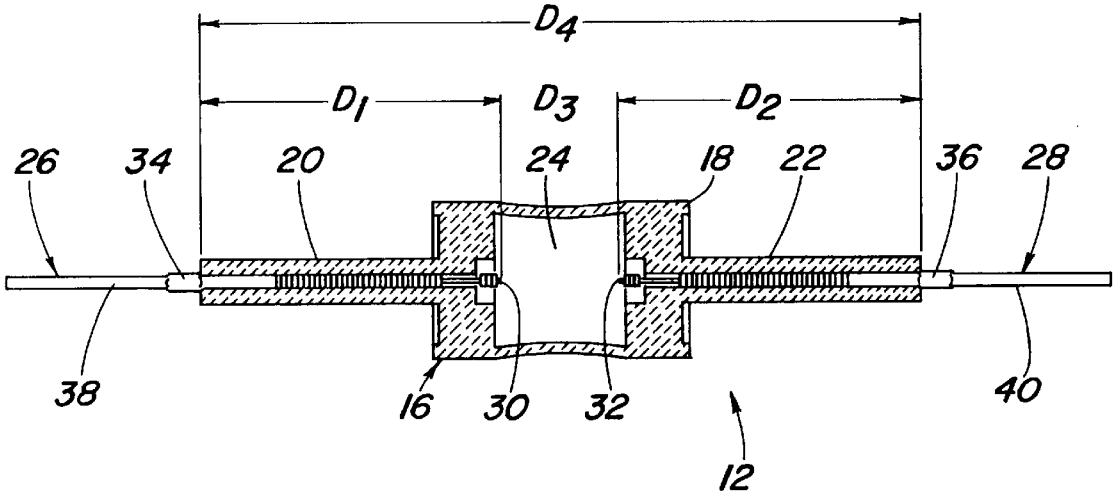
Fig. 2

CRIMP LENGTH GAUGE FOR CERAMIC METAL HALIDE ELECTRODES

BACKGROUND OF THE INVENTION

The present invention relates to the high intensity discharge (HID) lamp arts. It finds particular application in conjunction with ceramic metal halide discharge lamps and will be described with particular reference thereto. However, it should be appreciated that the present invention will also find application in conjunction with other types of high intensity discharge lamps and other applications which require precise control over setting arc gap lengths in a manufacturing environment.

High intensity discharge lamps operate by discharging an intense electrical arc between two electrodes. Ceramic metal halide discharge lamps typically include a ceramic arc tube mounted within an outer bulb. The ceramic arc tube includes a ceramic body having an electrode assembly sealed in each end thereof. One of the key advantages of ceramic metal halide discharge lamps is that they can provide good color uniformity. Achieving good color uniformity requires good control over arc tube voltage, which in turn is strongly dependent on the length of the arc gap, or the distance between the electrode tips.

During manufacture, the electrode assemblies are pushed into the ceramic arc tube body until crimps associated with each electrode assembly rest against the respective ends of the arc tube body. Each electrode tip position relative to an end of the arc tube body is determined by the distance from the electrode tip to the crimp. Thus, the length of the arc gap is equal to the overall length of the arc tube body less the sum of the two crimp lengths (i.e., the distance from the electrode tips to the respective crimps). With current production processes, the variation in overall arc tube body length is too great to permit adequate control of the arc gap length, and hence the arc tube voltage.

Accordingly, it has been considered desirable to develop a new and improved crimp length gauge for use with ceramic metal halide discharge lamps which meets the above-stated needs and overcomes the foregoing difficulties and others while providing better and more advantageous results.

SUMMARY OF THE INVENTION

In accordance with a first aspect of the present invention, a method of assembling a high intensity discharge lamp is disclosed. The method includes the steps of measuring an arc tube body, positioning an electrode relative to a crimper based on a measurement of the arc tube body, securing a stop to a portion of the electrode proximate the crimper, and inserting the electrode into the arc tube body until the stop abuts the arc tube body.

In accordance with a second aspect of the present invention, a method of assembling a high intensity discharge lamp is disclosed. The method includes the steps of measuring an arc tube body, determining an insertion length value based on a measurement of the arc tube body, and inserting a portion of an electrode into the arc tube body wherein the portion has a length substantially equal to the insertion length value.

In accordance with a third aspect of the present invention, a method of assembling a high intensity discharge lamp is disclosed. The method includes the steps of measuring an arc tube body, determining an offset value based on a measurement of the arc tube body, and inserting a portion of an electrode into the arc tube body wherein the portion has a length substantially equal to the sum of the offset value and an initial length value.

In accordance with a fourth aspect of the present invention, a crimp length gauge for use with a high intensity discharge lamp is disclosed. The gauge includes a base supporting an arc tube body, a movable gauge arm having a first portion contacting an end surface of the arc tube body, an electrode holder supporting an electrode in contact with a second portion of the gauge arm, and a crimper for securing a stop to the electrode at a position determined by the extent of movement of the gauge arm.

One advantage of the present invention is that it reduces arc gap variability.

Another advantage of the present invention is that it provides a high intensity discharge lamp having a symmetric arc gap that does not vary with arc tube body length.

Another advantage of the present invention is that it provides a simple lever arrangement which gauges the overall length of a ceramic arc tube body.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

FIG. 1 is a side view of an exemplary metal halide HID lamp having a ceramic arc tube mounted within an outer bulb;

FIG. 2 is a cross section view of the ceramic arc tube having an electrode assembly mounted in each end of a ceramic arc tube body;

DETAILED DESCRIPTION OF THE PREFERRED EMBODIMENTS

Figure 3:
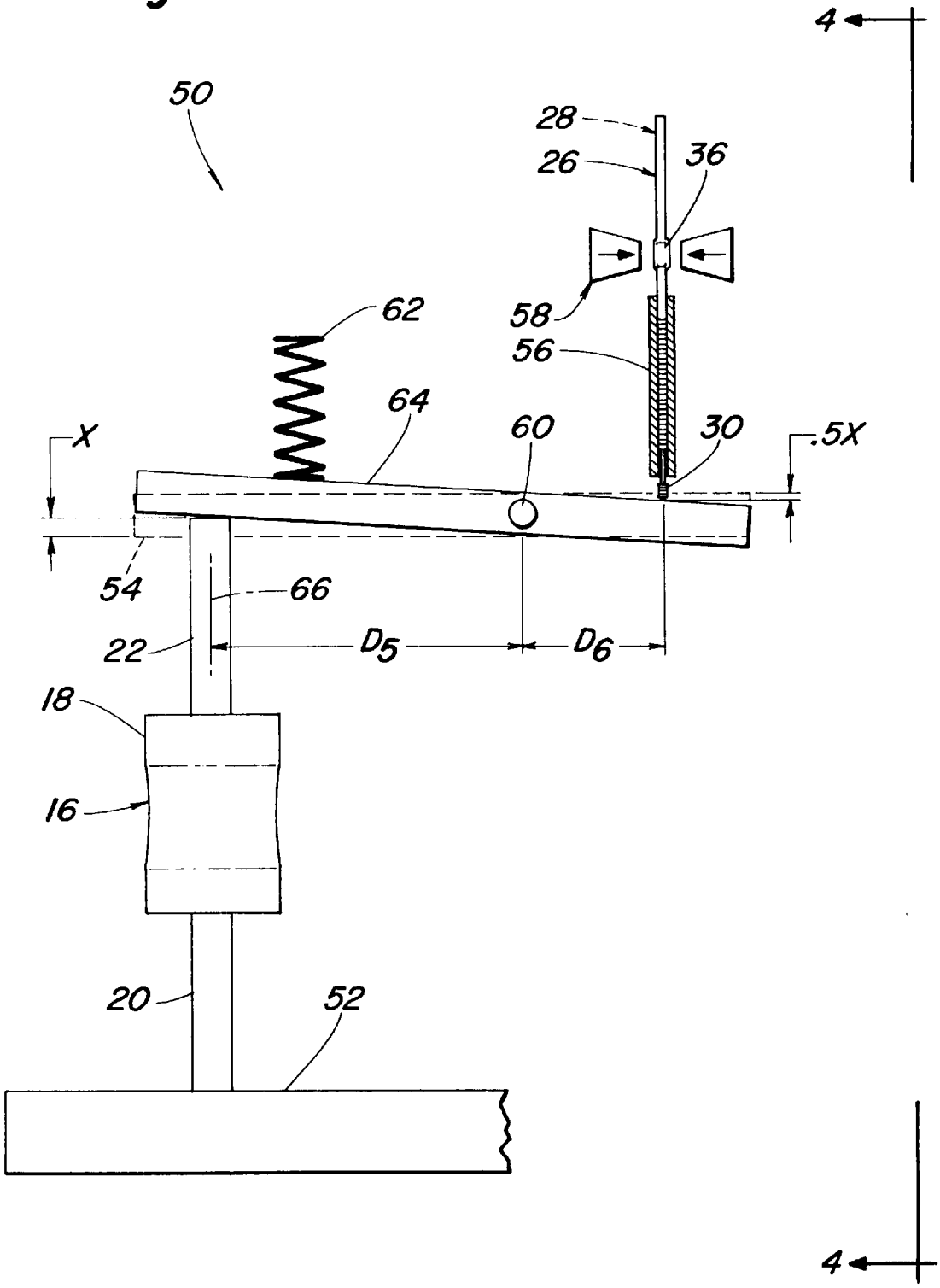
FIG. 3 is a diagrammatic view of a first embodiment of a crimp length gauge for use with the ceramic arc tube body and electrode assemblies of FIG. 2.

With reference to FIG. 1, an exemplary ceramic metal halide discharge lamp 10 includes an arc tube 12 mounted within an outer bulb 14. The arc tube 12 is formed from a ceramic material having translucent properties. The ceramic arc tube 12 is typically filled with metal halides, argon, and mercury. The outer bulb 14 is formed from a vitreous material such as glass or quartz. The outer bulb 14 typically is evacuated or contains nitrogen fill gas.

As shown in FIG. 2, the ceramic arc tube 12 includes a arc tube body 16 having a hollow cylindrical portion 18 and two tubular leg portions 20, 22 extending laterally from opposing ends of the cylindrical portion 18. The cylindrical portion 18 defines a closed cavity 24 where a high-intensity arc is maintained during use of the lamp 10.

The leg portions 20, 22 are each adapted to receive an electrode 26, 28. The electrodes 26, 28 each include a tip 30, 32 positioned at opposing ends of the closed cavity 24. Each electrode 26, 28 also includes a stop such as a shoulder 34, 36 which is secured to a lead wire portion 38, 40 of the respective electrode 26, 28. The shoulders 34, 36 abut respective free ends of the leg portions 20, 22 when the electrodes 26, 28 are secured to the arc tube body 16 as shown in FIG. 2.

During manufacture, the electrodes 26, 28 are pushed into the tubular leg portions 20, 22 until the shoulders 34, 36 rest against the respective ends of the tubular leg portions 20, 22. The position of the electrode tip 30 relative to the end of the tubular leg portion 20 is determined by a crimp length of the electrode 26. The crimp length of the electrode 26 is defined as the distance $D_1$ from the electrode tip 30 to the shoulder 34.

Likewise, the position of the electrode tip 32 relative to the end of the tubular leg portion 22 is determined by a crimp length of the electrode 28. The crimp length of the electrode 28 is defined as the distance $D_2$ from the electrode tip 32 to the shoulder 36.

An arc gap is defined as the distance separating the electrode tip 30 from the electrode tip 32. The length $D_3$ of the arc gap is equal to the overall length $D_4$ of the arc tube body 16 less the sum of the two crimp lengths $D_1$, $D_2$, (i.e., $D_3=D_4-_1-D_2$). With current production processes, the arc tube body length $D_4$ may vary on the order of tenths of a millimeter from one arc tube body 16 to the next.

Assuming that the crimp lengths $D_1$, $D_2$ of the respective electrodes 26, 28 are maintained within predetermined tolerances, then variations in the arc tube body length $D_4$ result in similar variations of the arc gap length $D_3$. Such arc gap length variations result in arc tube voltage variations, and thus poor color uniformity between respective metal halide discharge lamps 10. The present invention reduces arc gap variability by using the length $D_4$ of the arc tube body 16 to set the crimp length $D_1$, $D_2$ of one or both electrodes 26, 28.

Figure 4:
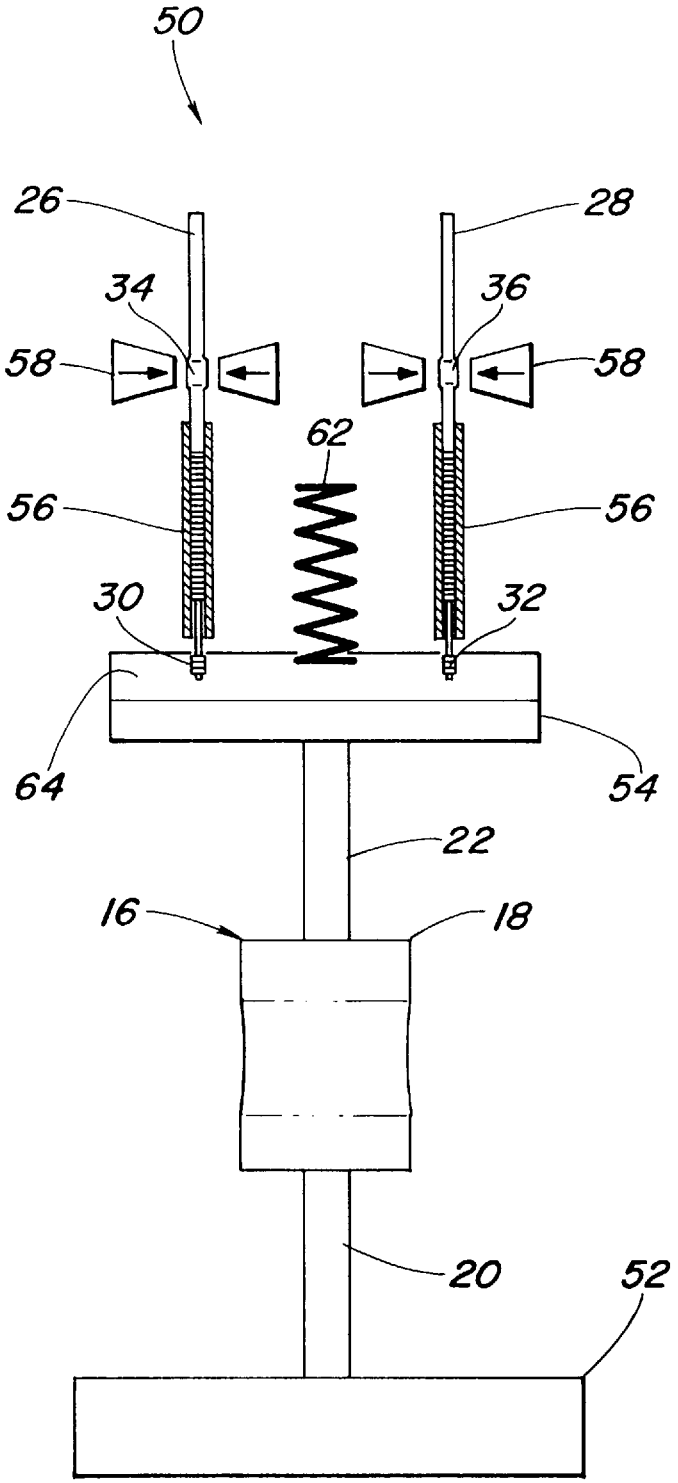
FIG. 4 is an end view of the crimp length gauge taken along the line 4—4 of FIG. 3.

Referring now to FIGS. 3 and 4, a crimp length gauge or fixture 50 includes a base plate 52, pivotal gauge arm 54, electrode holders 56, and crimpers 58. The base plate 52 is adapted to receive an arc tube body 16. The arc tube body 16 is placed on the base plate 52 so that a lower end portion of the gauge arm 54 rests against an end surface of one of the tubular leg portions 20, 22. Arc tube bodies of different lengths $D_4$ cause the gauge arm 54 to rotate to varying degrees about a pivot point 60 against the urging force of a spring member 62.

When an arc tube body 16 is placed on the base plate 52, the arc tube body 16 must be positioned substantially perpendicular (e.g. vertical) relative to the gauge arm 54, and hence the base plate 52. In addition, a central longitudinal axis 66 of the arc tube body 16 must also be spaced a predetermined distance $D_5$ away from the pivot point 60. In order to accurately position the arc tube body 16, the base plate 52 may include a positioner such as a known Vee-block.

The electrode holders 56 are positioned proximate an upper surface portion of the gauge arm 54. Uncrimped electrodes 26, 28 are respectively placed in the adjacent electrode holders 56 so that the electrode tips 30, 32 rest on an upper surface 64 of the gauge arm 54. The longitudinal or vertical position of the electrodes 26, 28 relative to the crimpers 58 is determined by the position of the gauge arm 54, which in turn depends on the length of the arc tube body 16. Thus, when the crimpers 58 are actuated to secure the shoulders to the electrodes, the crimp lengths $D_1$, $D_2$ of the electrodes 26, 28 are directly related to the length $D_4$ of the arc tube body 16. As defined herein, the crimpers 58 may include any mechanism, assembly or device which secures a stop to an electrode, such as by crimping, soldering, welding, scoring, bonding, and the like.

As the arc tube body length $D_4$ increases from $D_4$ to $D_4+X$, where $D_4+X$ is a length value and X is a length deviation value, the crimp lengths $D_1$, $D_2$ correspondingly increase from $D_1$ to $D_1+0.5X$, and from $D_2$ to $D_2+0.5X$, in order to maintain a constant arc gap $D_3$. Likewise, as the arc tube body length $D_4$ decreases from $D_4$ to $D_4-X$, the crimp lengths $D_1$, $D_2$ correspondingly decrease from $D_1$ to $D_1-0.5X$, and from $D_2$ to $D_2-0.5X$, in order to maintain a constant arc gap $D_3$.

This adjustment is assured by the fact that the distance $D_5$ between the central longitudinal axis 66 of arc tube body 16 and the pivot point 60 is twice the distance $D_6$ between the pivot point 60 and the electrode assemblies 26, 28 held within the electrode holders 56 (i.e., $D_5=2D_6$). Thus, a variation (X) in arc tube body length $D_4$ is translated into offsetting variations (0.5X) in crimp lengths $D_1$, $D_2$ which offsetting variations, when summed together, equal the variation (X) in arc tube body length.

Once the electrodes 26, 28 are crimped, the arc tube body 16 and the electrodes 26, 28 are removed from the crimp length gauge 50. The electrodes 26, 28 are inserted into the arc tube body 16 so as to maintain correspondence therebetween. That is, the electrodes 26, 28 are inserted into the respective tubular leg portions 20, 22 until the shoulders 34, 36 abut the respective ends of the leg portions 20, 22. The arc tube body 16 is then sealed and exhausted in a known manner to produce a finished ceramic arc tube 12. It should be appreciated that the electrodes 26, 28 may be inserted into holders (not shown) for storage or transport prior to insertion into the arc tube body 16.

Thus, the crimp length gauge 50 permits both electrodes 26, 28 to be crimped, either simultaneously or sequentially. As a result, half of the required correction is made on each electrode. In addition, since both electrodes are set to the same insertion length, the arc gap $D_3$ is inherently centered between the ends of the arc tube body 16.

Figure 5:
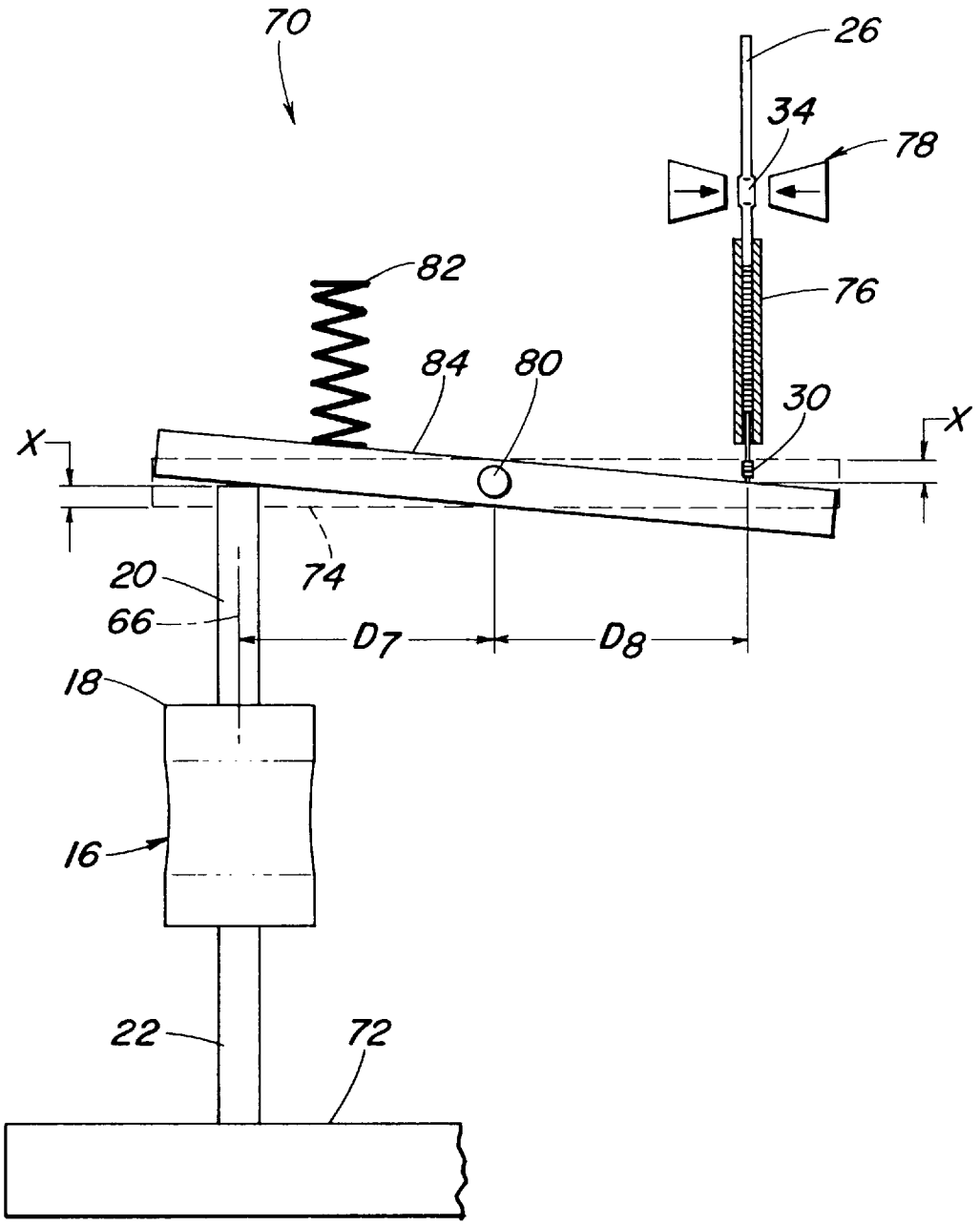
FIG. 5 is a diagrammatic view of a second embodiment of a crimp length gauge for use with the ceramic arc tube body and an electrode assembly of FIG. 2.

Referring now to FIG. 5, a crimp length gauge or fixture 76 includes a base plate 72, pivotal gauge arm 74, electrode holder 76, and crimper 78. The base plate 72 is adapted to receive an arc tube body 16. The arc tube body 16 is placed on the base plate 72 so that a lower end portion of the gauge arm 74 rests against an end surface of one of the tubular leg portions 20, 22. Arc tube bodies of different lengths $D_4$ cause the gauge arm 74 to rotate to varying degrees about a pivot point 80 against the urging force of a spring means 82.

The electrode holder 76 is positioned proximate an upper surface portion 84 of the gauge arm 74. An uncrimped electrode such as electrode 26 is placed in the electrode holder 76 so that the electrode tip 30 rests on the upper surface 84 of the gauge arm 74. The vertical or longitudinal position of the electrode 26 relative to the crimper 78 is determined by the position of the gauge arm 74, which in turn depends on the length of the arc tube body 16. Thus, when the crimper 78 is actuated, the crimp length of one of the electrodes, such as electrode 26, is directly related to the length $D_4$ of the arc tube body 16.

As the arc tube body length $D_4$ increases from $D_4$ to $D_4+X$, the crimp length D of the electrode 26 correspondingly increases by the same length from $D_1$ to $D_1+X$ in order to maintain a constant arc gap $D_3$ Likewise, as the arc tube body length $D_4$ decreases from $D_4$ to $D_4-X$, the crimp length $D_1$ correspondingly decreases by the same length from $D_1$ to $D_1-X$ in order to maintain a constant arc gap $D_3$.

This adjustment is assured by the fact that the distance $D_7$ between the central longitudinal axis 66 of arc tube body 16 and the pivot point 80 is exactly the same as the distance $D_8$ between the pivot point 80 and the electrode 26 held within the electrode holder 76 (i.e., $D_7=D_8$).

Once the electrode assembly 26 is crimped, the arc tube body 16 and the electrode assembly 26 are removed from the crimp length gauge 70. The electrode 26 is then inserted into the arc tube body 16 so as to maintain correspondence therebetween. That is, the electrode 26 is inserted into one of the tubular leg portions 20, 22, such as leg portion 20, until the shoulder 34 abuts the end of the leg portion 20. The electrode 26 may then be sealed in the leg portion 20 in a known manner. It should be appreciated that the electrode 26 may be inserted into a holder (not shown) for storage or transport prior to insertion into the arc tube body 16.

During a second sealing process, an electrode, such as electrode 28, with a fixed crimp length $D_2$ is used. Gauging the second electrode 28 is not necessary because gauging the first electrode 26 fully compensates for any variation in arc tube body length. Since the second electrode 28 is crimped at a fixed length, the sum of the two crimp lengths $D_1$, $D_2$ results in a precise setting of the arc gap $D_3$. The arc tube body 16 is then sealed and exhausted in a known manner to produce a finished ceramic arc tube 12.

Thus, the insertion or crimp length of one electrode is varied by means of a lever arrangement gauging the overall length of the arc tube body. In this way, the arc gap length does not vary with arc tube body length.

In most cases, the length deviation value (X) is small enough to be adequately compensated in the manner described above with regard to the gauge 70. However, if the required correction (X) is large when the arc tube body length $D_4$ decreases from $D_4$ to $D_4-X$, the crimp length $D_1-X$ may be so short that the electrode tip 30 is positioned too close to the ceramic arc tube body.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What we claim as new and desire to secure by Letters Patent of the United States is:

1. A method of assembling a high intensity discharge lamp, comprising the steps of:

measuring an arc tube body;

positioning an electrode relative to a crimper based on a measurement of the arc tube body;

securing a stop to a portion of the electrode proximate the crimper; and inserting the electrode into the arc tube body until the stop abuts the arc tube body.

2. The method of claim 1, wherein:

the measuring step includes the step of measuring a length value of the arc tube body, and the positioning step includes the step of positioning the electrode relative to the crimper based on the length value.

3. The method of claim 1, wherein:

the measuring step includes the step of measuring a length deviation value of the arc tube body, and the positioning step includes the step of positioning the electrode relative to the crimper based on the length deviation value.

4. The method of claim 1, wherein the measuring step includes the step of:

positioning a gauge arm based on the measurement of the arc tube body.

5. The method of claim 4, wherein the gauge arm positioning step includes the step of:

pivoting the gauge arm based on the measurement of the arc tube body.

6. The method of claim 1, wherein the positioning step includes the step of:

positioning a second electrode relative to the crimper based on the measurement of the arc tube body.

7. A method of assembling a high intensity discharge lamp, comprising the steps of:

measuring an arc tube body;

determining an insertion length value based on a measurement of the arc tube body; and inserting a portion of an electrode into the arc tube body, the portion having a length substantially equal to the insertion length value.

8. The method of claim 7, wherein:

the measuring step includes the step of measuring a length value of the arc tube body, and the determining step includes the step of determining the insertion length value based on the length value.

9. The method of claim 7, wherein:

the measuring step includes the step of measuring a length deviation value of the arc tube body, and the determining step includes the step of determining the insertion length value based on the length deviation value.

10. A method of assembling a high intensity discharge lamp, comprising the steps of:

measuring an arc tube body;

determining an offset value based on a measurement of the arc tube body; and inserting a portion of an electrode into the arc tube body, the portion having a length substantially equal to the sum of the offset value and an initial length value.

11. The method of claim 10, wherein:

the measuring step includes the step of measuring a length of the arc tube body, and the determining step includes the step of determining the offset value based on the length of the arc tube body.

12. The method of claim 10, wherein:

the measuring step includes the step of measuring a length deviation of the arc tube body, and the determining step includes the step of determining the offset value based on the length deviation of the arc tube body.

13. A crimp length gauge for use with a high intensity discharge lamp, comprising:

a base supporting an arc tube body;

a movable gauge arm having a first portion contacting an end surface of the arc tube body;

an electrode holder supporting an electrode in contact with a second portion of the gauge arm; and a crimper for securing a stop to the electrode at a position determined by the extent of movement of the gauge arm.

14. The gauge of claim 13, wherein the gauge arm includes a pivot positioned substantially half-way between the arc tube body and the electrode.

15. The gauge of claim 13, wherein the gauge arm includes a pivot positioned substantially twice the distance away from the arc tube body as the distance away from the electrode.

16. The gauge of claim 15, further including a second electrode holder for supporting a second electrode in contact with the second portion of the gauge arm.

* * * * *